US011565863B2

(12) United States Patent
Mondini et al.

(10) Patent No.: US 11,565,863 B2
(45) **Date of Patent: *Jan. 31, 2023**

(54) METHOD FOR MAKING A CONTAINER COMPRISING AN OUTER SKELETON AND AN INNER LAYER OF THERMOPLASTIC MATERIAL, RELATED CONTAINER AND PAPER-INDUSTRY ARTICLE USED IN THE METHOD

(71) Applicant: G.MONDINI S.P.A., Cologne (IT)

(72) Inventors: Paolo Mondini, Cologne (IT); Giovanni Mondini, Cologne (IT); Daniel Paderni, Castegnato (IT)

(73) Assignee: G.MONDINI S.P.A., Cologne (IT)

( * ) Notice: Subject to any disclaimer, the term of this patent is extended or adjusted under 35 U.S.C. 154(b) by 0 days.

This patent is subject to a terminal disclaimer.

(21) Appl. No.: 17/319,813

(22) Filed: May 13, 2021

(65) Prior Publication Data

US 2021/0261314 A1 Aug. 26, 2021

Related U.S. Application Data

(62) Division of application No. 16/272,465, filed on Feb. 11, 2019, now Pat. No. 11,034,498.

(51) Int. Cl.
*B65D 5/20* (2006.01)
*B65D 75/36* (2006.01)

(52) U.S. Cl.
CPC ..... *B65D 75/366* (2013.01); *B65D 5/2033* (2013.01); *B65D 2577/2025* (2013.01)

(58) Field of Classification Search
CPC ..... B65D 75/366; B65D 5/2033; B65D 2577/2025; B65D 81/3453; B65D 5/4266; B65D 77/0413
(Continued)

(56) References Cited

U.S. PATENT DOCUMENTS 2,328,563 A 9/1943 Lichter
2,736,065 A 2/1956 Wilcox
(Continued)

FOREIGN PATENT DOCUMENTS

EP 3501813 A2 6/2019
EP 3693284 A1 8/2020
(Continued)

*Primary Examiner* — Steven A. Reynolds
(74) *Attorney, Agent, or Firm* — Pearne & Gordon LLP; John P. Murtaugh

(57) ABSTRACT

A paper-industry article for making an outer skeleton (3) of a container (2) which also includes an inner layer (9) of thermoplastic material and which has a bottom wall (6), a plurality of lateral walls (5) and an annular perimetric flange (4), the outer skeleton (3) extending at the perimetric flange (4), at the lateral walls (5), at the bottom wall (6), wherein the paper-industry article (1) includes a continuous annular frame (7) intended to constitute the outer skeleton (3) of the container (2) at the perimetric flange (4) of the container (2), and a plurality of wings (10) which extend starting from the continuous annular frame (7), each of the wings (10) being intended to constitute the outer skeleton (3) at one of the lateral walls (5) of the container (2), and at least one of the wings (10) also being intended to constitute the outer skeleton (3) also at the bottom wall (6) of the container (2).

17 Claims, 8 Drawing Sheets

(58) Field of Classification Search
USPC ..... 206/461
See application file for complete search history.

(56) References Cited

U.S. PATENT DOCUMENTS

| | | | | |
|---|---|---|---|---|
| 3,104,012 | A * | 9/1963 | Beamish | B65D 77/22 206/525 |
| 3,135,455 | A | 6/1964 | Santangelo | |
| 3,358,900 | A | 12/1967 | Perdue et al. | |
| 3,489,331 | A * | 1/1970 | Andersson | B65D 5/4279 D7/323 |
| 3,756,495 | A | 9/1973 | Bemiss | |
| 3,917,155 | A | 11/1975 | Bemiss | |
| 4,046,310 | A | 9/1977 | Gustafsson | |
| 4,257,530 | A | 3/1981 | Faller | |
| 4,351,473 | A | 9/1982 | Manizza | |
| 4,533,065 | A | 8/1985 | Ghazal et al. | |
| 4,779,758 | A | 10/1988 | Chazal et al. | |
| 5,048,716 | A | 9/1991 | Bodet et al. | |
| 5,253,801 | A | 10/1993 | Bernstein | |
| 5,533,623 | A | 7/1996 | Fischer | |
| 5,839,652 | A | 11/1998 | Ben-Haim | |
| 8,011,568 | B2 | 9/2011 | Maeaettae et al. | |
| 9,415,887 | B2 | 8/2016 | Zwaga et al. | |
| 9,718,576 | B2 | 8/2017 | Moore | |
| 10,647,466 | B2 | 5/2020 | Zwaga et al. | |
| 10,689,147 | B2 | 6/2020 | Nikolic | |
| 11,034,498 | B2 * | 6/2021 | Mondini | B31B 50/44 |
| 2004/0226850 | A1 | 11/2004 | Behnke et al. | |
| 2011/0259784 | A1 | 10/2011 | Tye et al. | |
| 2013/0327821 | A1 | 12/2013 | Zwaga et al. | |
| 2018/0022529 | A1 | 1/2018 | Tye | |
| 2020/0047940 | A1 | 2/2020 | Tye et al. | |
| 2020/0047975 | A1 | 2/2020 | Tye et al. | |
| 2020/0247571 | A1 | 8/2020 | Zwaga | |
| 2020/0255200 | A1 | 8/2020 | Mondini et al. | |
| 2020/0346794 | A1 | 11/2020 | Ormaechea et al. | |

FOREIGN PATENT DOCUMENTS

| | | | |
|---|---|---|---|
| FR | 2406522 | A1 | 5/1979 |
| FR | 2826938 | A1 | 1/2003 |
| FR | 2933329 | A1 | 1/2010 |
| GB | 1314148 | A | 4/1973 |
| JP | 2006290368 | A | 10/2006 |
| WO | 2012049005 | A1 | 4/2012 |
| WO | 2018017783 | A1 | 1/2018 |
| WO | 2018178508 | A1 | 10/2018 |
| WO | 2019020863 | | 1/2019 |
| WO | 2019092323 | A1 | 5/2019 |
| WO | 2020033350 | | 2/2020 |
| WO | 2020033352 | | 2/2020 |
| WO | 2020120840 | A1 | 6/2020 |

* cited by examiner

METHOD FOR MAKING A CONTAINER COMPRISING AN OUTER SKELETON AND AN INNER LAYER OF THERMOPLASTIC MATERIAL, RELATED CONTAINER AND PAPER-INDUSTRY ARTICLE USED IN THE METHOD

This invention relates to a method for making a container comprising an outer skeleton and an inner layer of thermoplastic material, as well as the container which can be made in this way and a paper-industry article used for forming the outer skeleton of the container.

In particular, this invention relates to those containers whose outer skeleton is constituted of a paper-industry article, that is to say, a paper-, cardboard- or paperboard-based article, which comprises a plurality of flaps of material connected to each other, and usually provided with fold lines, and which, starting from a flat configuration in which it extends mainly in one plane, can be brought to a three-dimensional configuration corresponding to the shape of the outer skeleton to be formed, by means of suitable folding of the various flaps.

Currently, this kind of containers may belong to two types.

In the first type, the outer skeleton is constituted of a single sheet of cardboard or paperboard which extends continuously on the entire outer surface of the container. That sheet, before taking on the three-dimensional shape of the skeleton, has a central zone (intended to constitute the bottom wall of the skeleton, surrounded by a main annular portion of material, intended to constitute the lateral walls of the skeleton. During the step of folding the lateral walls upwards relative to the bottom wall, in the lateral walls themselves wrinkled zones are created, suitable for compensating for the smaller surface extension deriving from folding. In many applications, the main annular portion is surrounded by a further secondary annular portion suitable for constituting a perimetric flange of the container, which extends outward starting from the upper edge of the lateral walls. Since the perimetric flange also has a plan extension which is less than that of the secondary annular portion, the wrinkled zones also continue on the annular flange.

In contrast, in the second prior art type the outer skeleton comprises a main flap, and a plurality of secondary flaps which extend outward from the main flap. The main flap is the one which in the container is positioned at the bottom wall, whilst the secondary flaps are those which in the container are positioned at the lateral walls. Depending on the embodiments, the secondary flaps may or may not comprise outer projections which, if present, are positioned at the upper perimetric flange of the container.

Unlike those of the first type described above, the skeletons of the second type do not usually have wrinkled zones and a degree of continuity of extension of the lateral walls or of the perimetric flange is obtained exclusively by attempting to bring the edges of the adjacent flaps as close to each other as possible. Examples of containers which use outer skeletons of the second type are described in the following documents: U.S. Pat. Nos. 3,358,900, 3,489,331, 4,046,310, FR 2406522, U.S. Pat. No. 5,253,801, FR 2826938, FR 2933329, WO 2012/049005 and WO 2018/017783.

However, both of the prior art technologies have several Important disadvantages.

In fact, the containers at which this invention is aimed are usually intended to allow the packaging of food products in a controlled atmosphere. On one hand, the inner thermoplastic material is such that it guarantees preservation of the protective atmosphere for the entire useful life of the of the food product. On the other hand, once the product has been inserted into the container, the container is sealed at the top with a protective film, which is welded to the inner thermoplastic material. With both types of containers the sealing usually takes place at the perimetric flange, but may also extend on the rest of the free surface of the container (known as Skin packaging).

However, over the years it has been possible to ascertain that the presence of the outer skeleton at the perimetric flange, although desirable in order to guarantee container mechanical stiffness, makes the operations for welding the upper protective film critical. In fact at, respectively, the wrinkled zones or the discontinuity zones of the skeleton, the welding may in many cases be either ineffective (that is to say, leaving small gaps for the passage of air) or in any case weak (that is to say, such that it easily yields following handling by users).

In this context the technical purpose which forms the basis of this invention is to provide both a method for making a container comprising an outer skeleton and an inner layer of thermoplastic material, and a related container, which overcome the above-mentioned disadvantages.

In particular it is the technical purpose of this invention to provide a method and a container which make the operations for welding an upper protective film easier.

Another technical purpose of this invention is to provide a method and a container which make it possible to carry out the operations for welding an upper protective film in a similar way to that for thermoformed containers which have no outer skeleton.

The technical purpose and the aims indicated are substantially achieved by a method for making a container comprising an outer skeleton and an inner layer of thermoplastic material and by a container, as described in the appended claims. That technical purpose specified and those aims indicated are specifically achieved thanks to a paper-industry article as described in the appended claims.

In fact, at the heart of this invention is a paper-industry article which, thanks to its innovative structure, allows the container outer skeleton to be made with a perimetric flange which is continuous and extends substantially flat, that is to say, without either wrinkled zones or other discontinuities typical of the skeletons of the prior art.

The paper-industry article is usually a single object, advantageously without detachable parts, which is made in such a way that all of the parts of the outer skeleton are connected to the continuous perimetric flange.

Furthermore, according to the preferred embodiments, both in the skeleton in the three-dimensional configuration, and in the paper-industry article before the skeleton is formed, the continuous perimetric flange also determines the maximum outer dimension (in other words, at no stage does the paper-industry article have parts projecting along its length or width).

Further features and advantages of this invention are more apparent in the detailed description which follows of several preferred, non-limiting example embodiments of a method for making a container comprising an outer skeleton and an inner layer of thermoplastic material, as well as the container obtainable in this way and the paper-industry article used in the method, which are illustrated with reference to the accompanying drawings, in which.

Figure 1:
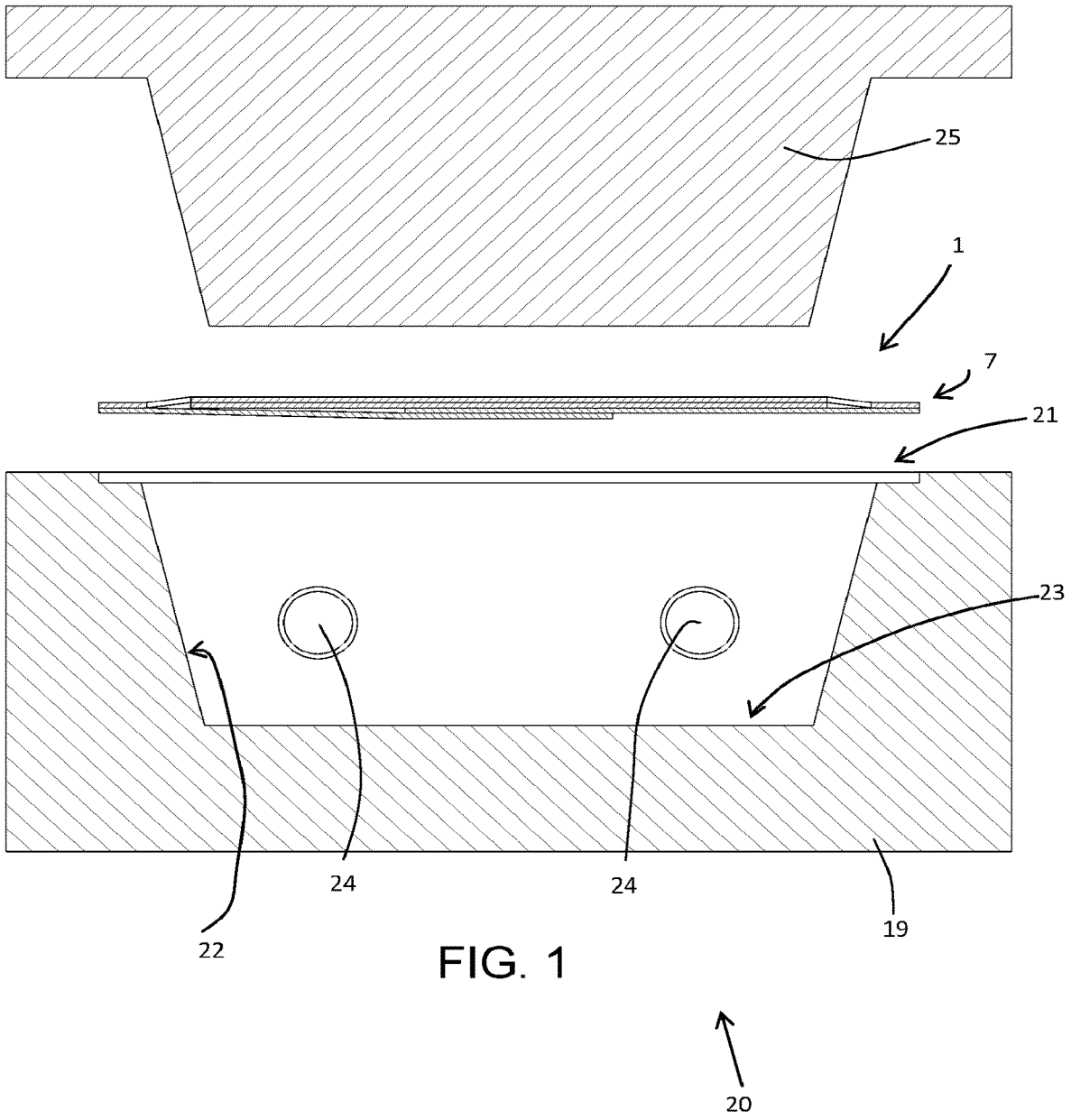
FIG. 1 is a schematic vertical section of a first step of the method according to this invention.

Since, as already indicated, at the heart of this invention is the innovative paper-industry article 1 provided, hereinafter there is initially a description of the paper-industry article 1 and only then the container 2 which comprises it and the method for making the container 2.

In the context of this description, the term paper-industry article 1 means a paper-, cardboard- or paperboard-based product obtainable in the paper industries or laboratories, which comprises either a single sheet or two or more sheets fixed to each other, shaped in such a way as to define the various parts of interest, and advantageously equipped with fold lines which allow the paper-industry article 1 to be made to adopt, in a relatively easy way, the final shape of the outer skeleton 3 to be made.

The context of this invention includes those paper-industry articles which allow an outer skeleton 3 to be made which, in the final container 2, extends at the perimetric flange 4, and at the lateral walls 5, and at the bottom wall 6. It should be noticed that the extension of the outer skeleton 3 at the perimetric flange 4, and/or the lateral walls 5, and/or the bottom wall 6 may affect the relative part (wall or flange) either completely or partially. Only regarding the perimetric flange 4 it is important that the paper-industry article 1 has a continuous annular frame 7 which extends along the entire extension of the perimetric flange 4 around the container 2; otherwise, the width of the continuous annular frame 7 may even not coincide with that of the perimetric flange 4, provided that it is such that it constitutes a contact element for application of a sealing film to the perimetric flange 4. The continuous annular frame 7 will advantageously have a continuous, flat upper surface 8, suitable for in use being coupled to the inner layer 9 of thermoplastic material of the container 2.

The paper-industry article 1 has a plurality of wings 10 which extend from the continuous annular frame 7, each intended to constitute the outer skeleton 3 at one of the lateral walls 5 of the container 2.

Figure 5:
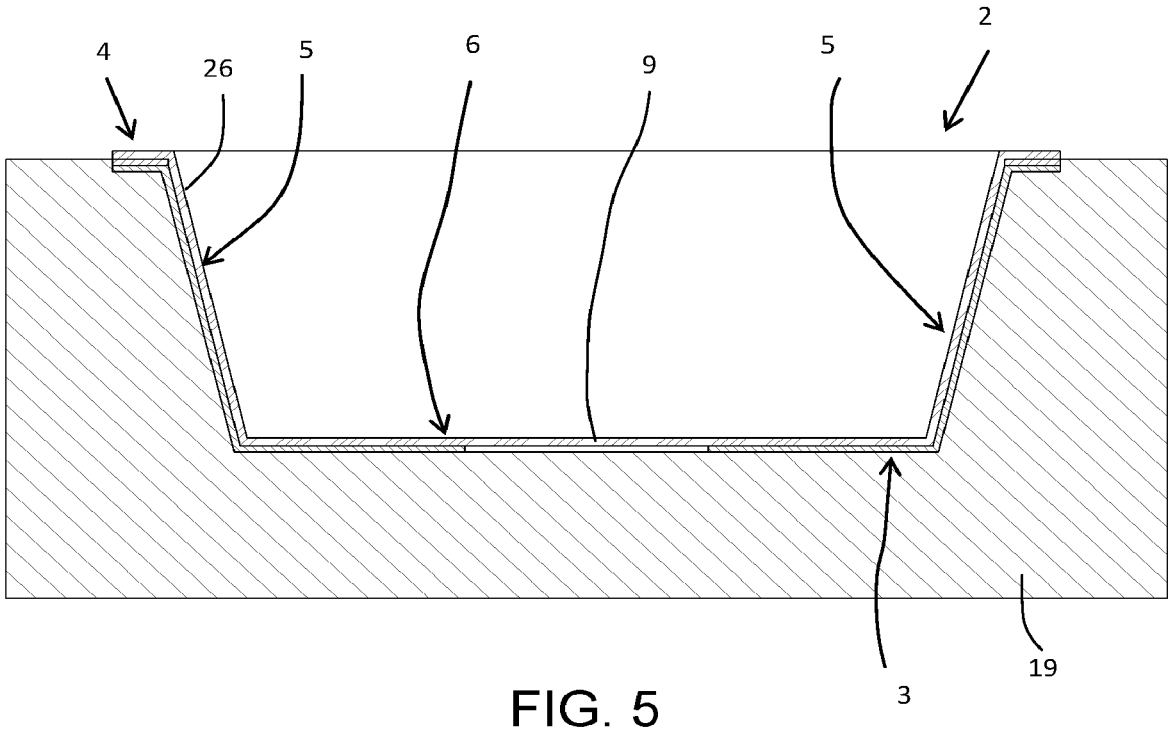
FIG. 5 is a schematic vertical section of a fifth step of the method according to this invention.

Moreover, at least one of the wings 10 is intended to constitute the outer skeleton 3 even at the bottom wall 6 of the container 2. However, depending on the embodiments, it may be the case that the part of the outer skeleton 3 intended to be located at the bottom wall 6 of the container 2, may be constituted of a single wing 10, or one or more pairs of opposite wings 10, or jointly of all of the wings 10. The latter case corresponds to what is illustrated in the accompanying figures in which, at the bottom wall 6 of the container 2 (FIGS. 5 and 8), the outer skeleton 3 defines a frame obtained by joining four flaps each of which is connected to a different wing 10.

Advantageously, the paper-industry article 1 may comprise a number of wings 10 equal to the number of lateral walls 5 of the container 2.

In the preferred embodiments, each wing 10 comprises a main portion 11 shaped in such a way as to entirely define the outer skeleton 3 at one of the lateral walls 5. In some embodiments each wing 10 also has an additional portion 12 shaped in such a way as to partly define the outer skeleton 3 at the bottom wall 6.

Preferably, the paper-industry article 1 has fold lines at the connection zones between its portions which are intended to constitute the outer skeleton 3 at, respectively, the perimetric flange 4, each of the lateral walls 5 and the bottom wall 6. In the accompanying figures the fold lines, which may even incorporate one or more notches, are represented by dashed lines with long and short dashes.

Figure 7:
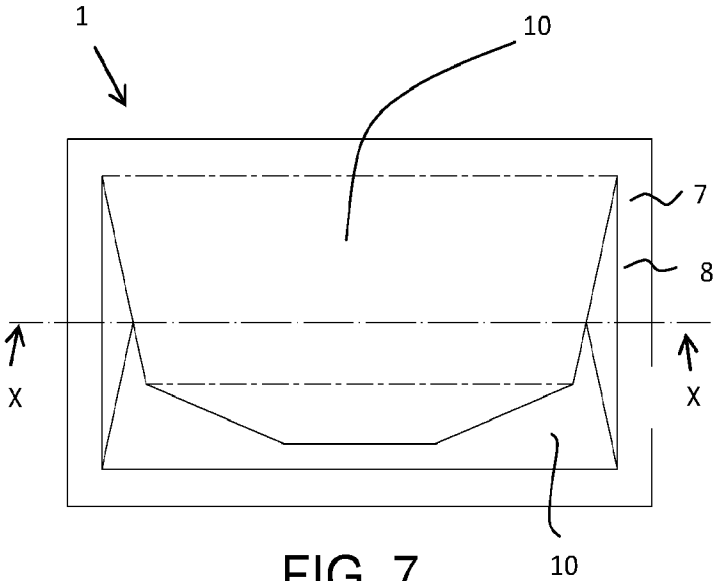
FIG. 7 is a top view of the paper-industry article visible in FIG. 1 and used for making the outer skeleton of FIG. 6.
Figure 10:
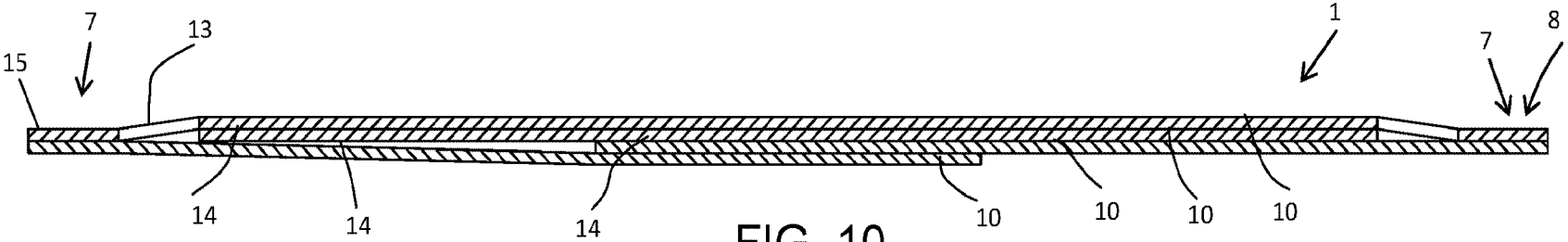
FIG. 10 is a cross-section according to the line X-X of the paper-industry article of FIG. 7.
Figure 12:
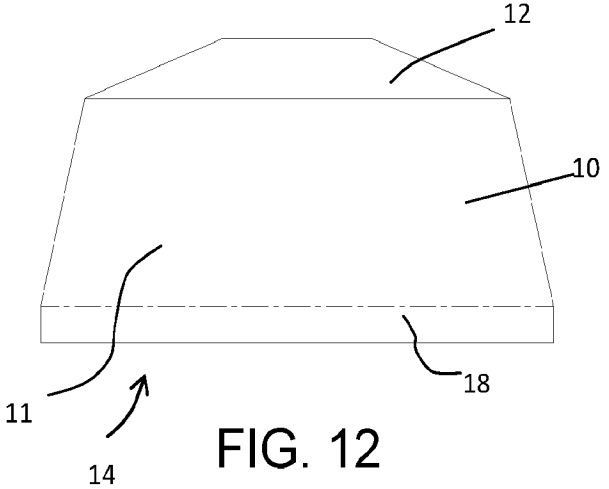
FIG. 12 is a top view of a first lower sheet which is part of the paper-industry article of FIG. 7.
Figure 14:
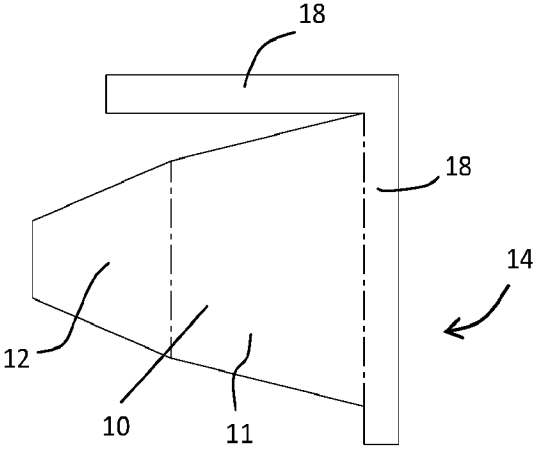
FIG. 14 is a top view of a third lower sheet which is part of the paper-industry article of FIG. 7.
Figure 11:
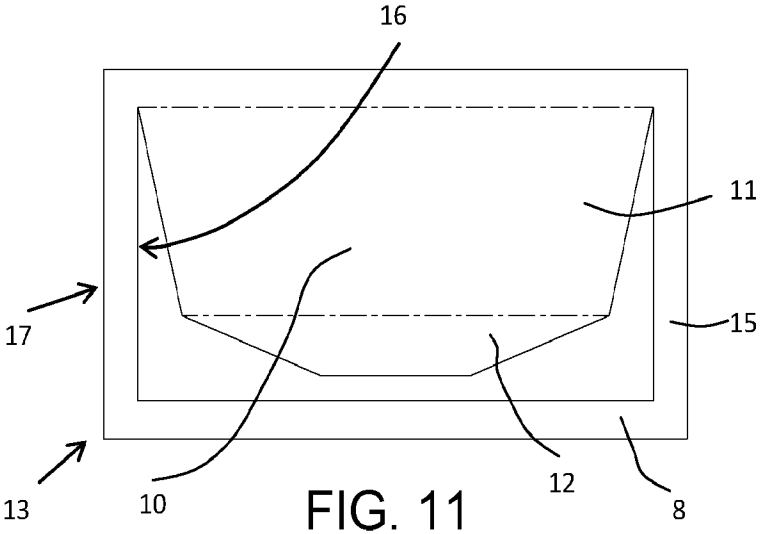
FIG. 11 is a top view of an upper sheet which is part of the paper-industry article of FIG. 7.
Figure 13:
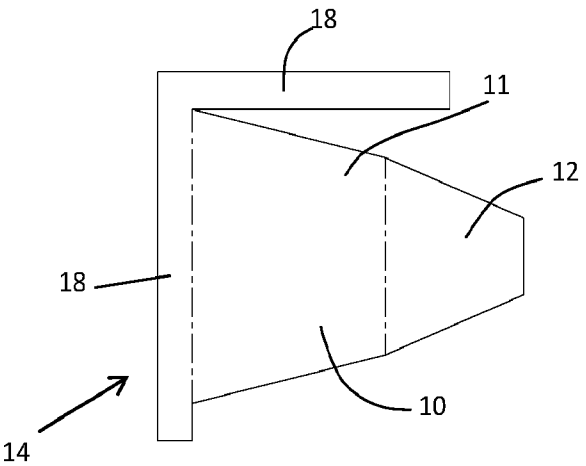
FIG. 13 is a top view of a second lower sheet which is part of the paper-industry article of FIG. 7.

Advantageously, before use, that is to say, when it adopts a flat configuration like that shown in FIGS. 7 and 10), the paper-industry article 1 extends mainly parallel to a main plane of extension of the continuous annular frame 7; that means that the thickness of the paper-industry article 1 is clearly less than the extension dimensions of the paper-industry article 1 parallel to the main plane of extension (length and width). It should be noticed that, in the accompanying figures, the main plane of extension corresponds to the plane of the drawing of FIG. 7, and, to make the structure of the various parts clearer, the thicknesses of the various sheets of material have been shown much greater than those usually actually used for real paper-industry articles.

In some embodiments, in the flat configuration of the paper-industry article 1 the continuous annular frame 7 is at least partly superposed on one or more of the wings 10.

Figure 8:
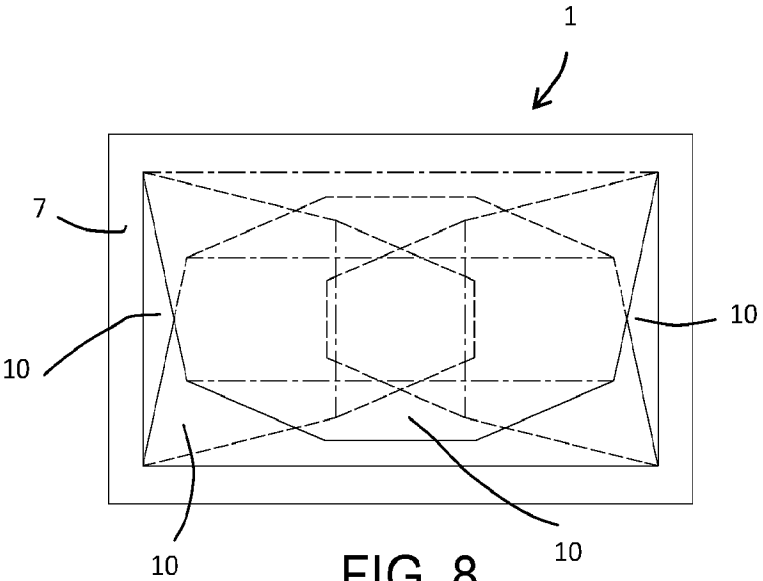
FIG. 8 shows the paper-industry article of FIG. 7 with some parts in the background visible in transparency.

Moreover, in some embodiments, at least some of the wings 10 are partly superposed on each other (FIG. 8). The extent of the superposing will depend, from one case to another, on the structure and dimensions of the outer skeleton 3. In the case of the embodiment illustrated, in which the lateral walls 5 of the container 2 are relatively high compared with the total extension of the container 2, the extent of the overlap between the wings 10 is relatively great.

Figure 6:
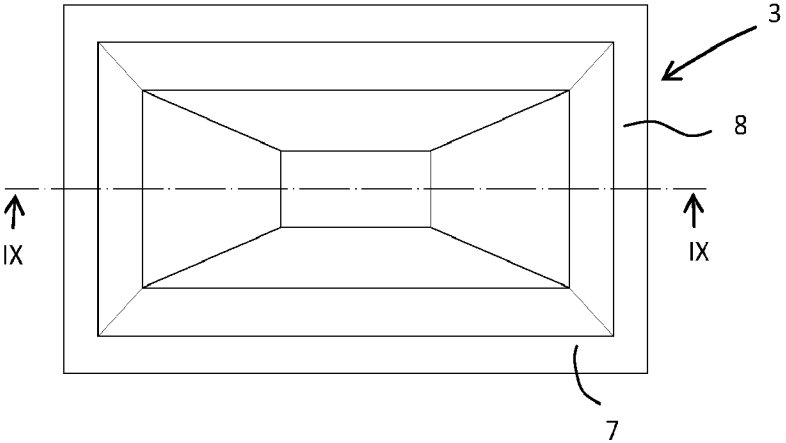
FIG. 6 is a top view of the outer skeleton formed in the step of FIG. 3 of the method according to this invention.

Depending on the embodiment, one or more wings 10 may be made and/or connected to the continuous annular frame 7 in such a way as to extend inward (FIG. 6) or outward from the frame itself (solution not illustrated). In the former case, if observed in plan view, the one or more wings 10 extend cantilever-style from an inner side of the continuous annular frame 7, whilst in the latter case they extend cantilever-style from an outer side of it.

Figure 9:
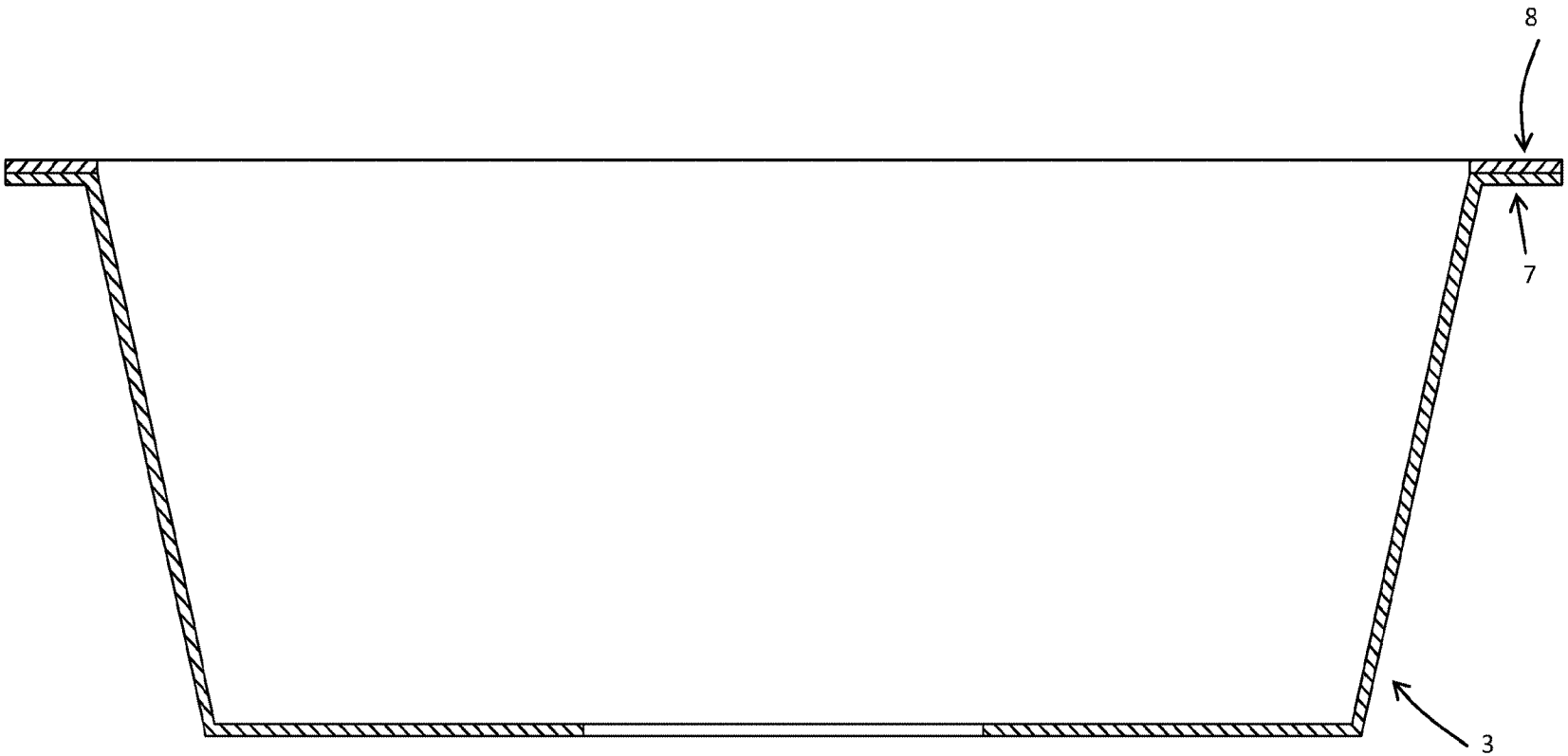
FIG. 9 is a cross-section according to the line IX-IX of the outer skeleton of FIG. 6.

However, in the preferred embodiment, if observed perpendicularly to the main plane of extension, the paper-industry article 1 has an outer profile defined by an outer portion of the continuous annular frame 7, that is to say, in the flat configuration (before use—FIGS. 6, 7 and 9) it does not comprise elements which have components of extension which, parallel to the main plane of extension, come out from the continuous annular frame 7. However, in other embodiments, in the flat configuration the wings 10 may extend outward from the continuous annular frame 7, then be folded inward during forming of the three-dimensional outer skeleton 3.

According to one embodiment, the paper-industry article 1 comprises at least one main sheet 13 and one or more secondary sheets 14 which are connected to the main sheet 13. In the main sheet 13 there is an annular portion 15 which defines at least the continuous upper surface 8 of the continuous annular frame 7 and which has an inner edge 16 and an outer edge 17. The one or more secondary sheets 14 are fixed under the annular portion 15 so that each defines one or more wings 10. Depending on the requirements, the part of each secondary sheet 14 which is directly adjacent to a wing 10, and is fixed under the annular portion 15, may be considered as part of the wing 10 or as part of the continuous annular frame 7.

However, preferably, the main sheet 13 also defines at least one of the wings 10, advantageously more than one if the respective dimensions and structure allow them to coexist in a single flat sheet of material, that is to say, if they are not such that they overlap when the paper-industry article 1 is in the flat configuration.

Figure 16:
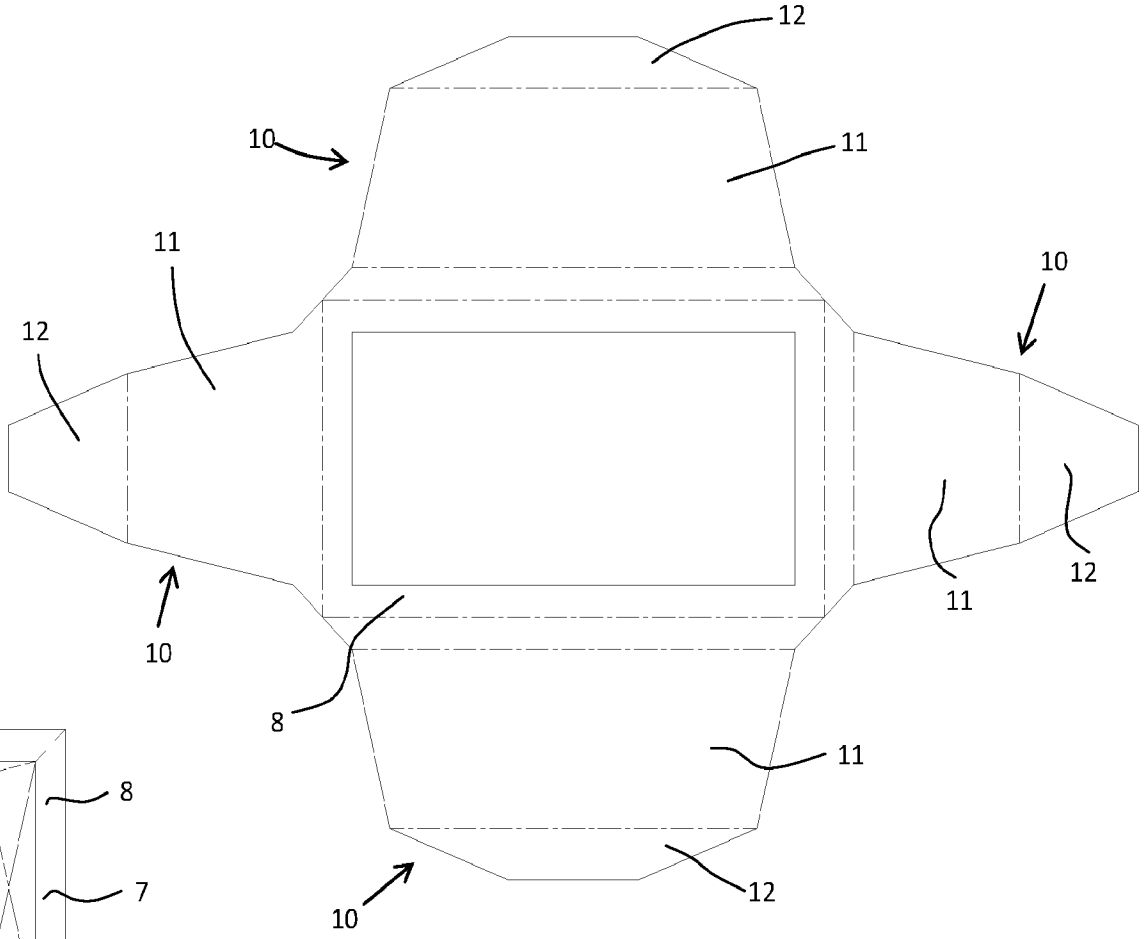
FIG. 16 shows fully flat a single main sheet which, once folded, constitutes the paper-industry article of FIG. 15.
Figure 15:
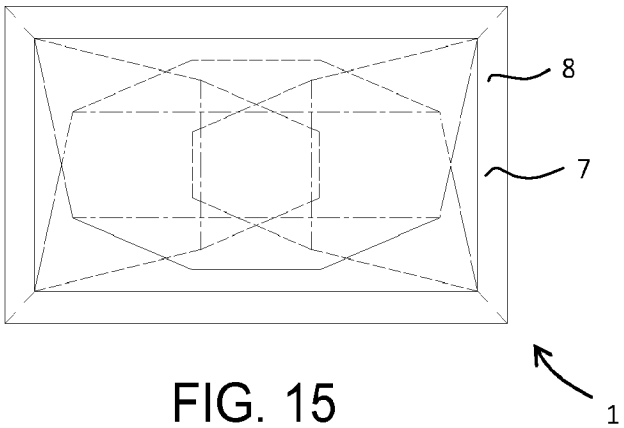
FIG. 15 shows an alternative embodiment of the paper-industry article of FIG. 8.

When the annular sheet constitutes both the continuous annular frame 7, and one of the wings 10, and the latter must extend inward relative to the continuous annular frame 7, two alternative solutions may be used. In a first case, the wing 10 may simply extend inward starting from the inner edge 16 of the annular portion 15. In a second case, the wing 10 may extend from the outer edge 17 of the annular portion 15, be folded under the annular portion 15, around the outer edge 17, so that the rest of it then extends inside the continuous annular frame 7 (FIGS. 15 and 16).

In the embodiment illustrated in FIGS. 7 and 8, in which each wing 10 has a degree of overlap with all of the others, the paper-industry article 1 comprises the main sheet 13, which defines the annular portion 15 and a first wing 10, and three secondary sheets 14, which each define one of the other wings 10 and which are fixed under the annular portion 15. Moreover, in the embodiment illustrated, each of the secondary sheets 14 defines a stretch 18 of an additional frame which has the same shape and extension as the annular portion 15 of the main sheet 13. In fact, in some applications it may be advantageous for the continuous annular frame 7 to have a thickness that is substantially constant along its entire extension. However, in other embodiments, it is possible that the secondary sheets 14 do not define the additional frame, or that they only define several stretches 18 of it. In another embodiment illustrated in FIGS. 15 and 16, the same result may be achieved by making the paper-industry article 1 using a single main sheet 13 which defines all of the wings 10. In the case illustrated in FIG. 16, relative to the flat main sheet 13 all of the wings 10 extends outward from the outer edge 17 of the annular portion 15. In contrast, in the finished paper-industry article 1, all of the wings 10 are folded through approximately 180° around the outer edge 17, so that they all extend inside the continuous annular frame 7.

Finally, advantageously, the paper-industry article 1 may be made in such a way as to facilitate the operations for thermoforming the inner thermoplastic layer 9. For that purpose it may, for example, have one or more holes and/or one or more slits and/or one or more outlines which, in use, are suitable for allowing the passage of air between an upper part (that intended to make contact with the inner layer 9) and a lower part of the outer skeleton 3. In particular, such devices may be adopted at the wings 10. As regards the above-mentioned outlines, these refer to particular shapes of the edges of the wings 10, such that they form passages for the air when the edges of adjacent wings 10 are positioned side by side in the outer skeleton 3 in the three-dimensional configuration. In particular, the holes or slits may be made at the fold lines.

As already indicated, this invention also relates to the container 2 comprising an outer skeleton 3 constituted of a paper-industry article 1 of the type described above, and an inner layer 9 of thermoplastic material coupled to the upper part of the outer skeleton 3.

That container 2 has a bottom wall 6, a plurality of lateral walls 5 connected at the bottom to the bottom wall 6 and an annular perimetric flange 4 which extends outward from an upper edge of the lateral walls 5.

The inner layer 9 of thermoplastic material extends continuously at the bottom wall 6, the lateral walls 5 and the perimetric flange 4, whilst the outer skeleton 3, although also extending at the bottom wall 6, the lateral walls 5 and the perimetric flange 4, may affect them either completely or only partially.

Advantageously, in the container 2, pairs of adjacent wings 10 define the outer corners of the lateral walls 5.

Finally, this invention relates to the method for making a container 2 comprising an outer skeleton 3 and an inner layer 9 of thermoplastic material coupled to the outer skeleton 3, the method being based on use of the paper-industry article 1 described above.

In its most general embodiment, the method comprises one after another, the operating steps of taking the paper-industry article 1, making the outer skeleton 3 (in its three-dimensional form) using the paper-industry article 1, and thermoforming the inner layer 9 of thermoplastic material directly on the outer skeleton 3, thereby fixing it to the outer skeleton.

In the preferred embodiment, the step of making the outer skeleton 3 comprises first the step of inserting the paper-industry article 1 into a female mould 19 of a thermoforming device 20 (FIG. 1). If the paper-industry article 1 has, according to the preferred embodiment, a length and width which are equal to those of the continuous annular frame 7, this may be advantageously placed in a suitable seat 21 made in the female mould 19.

Figure 17:
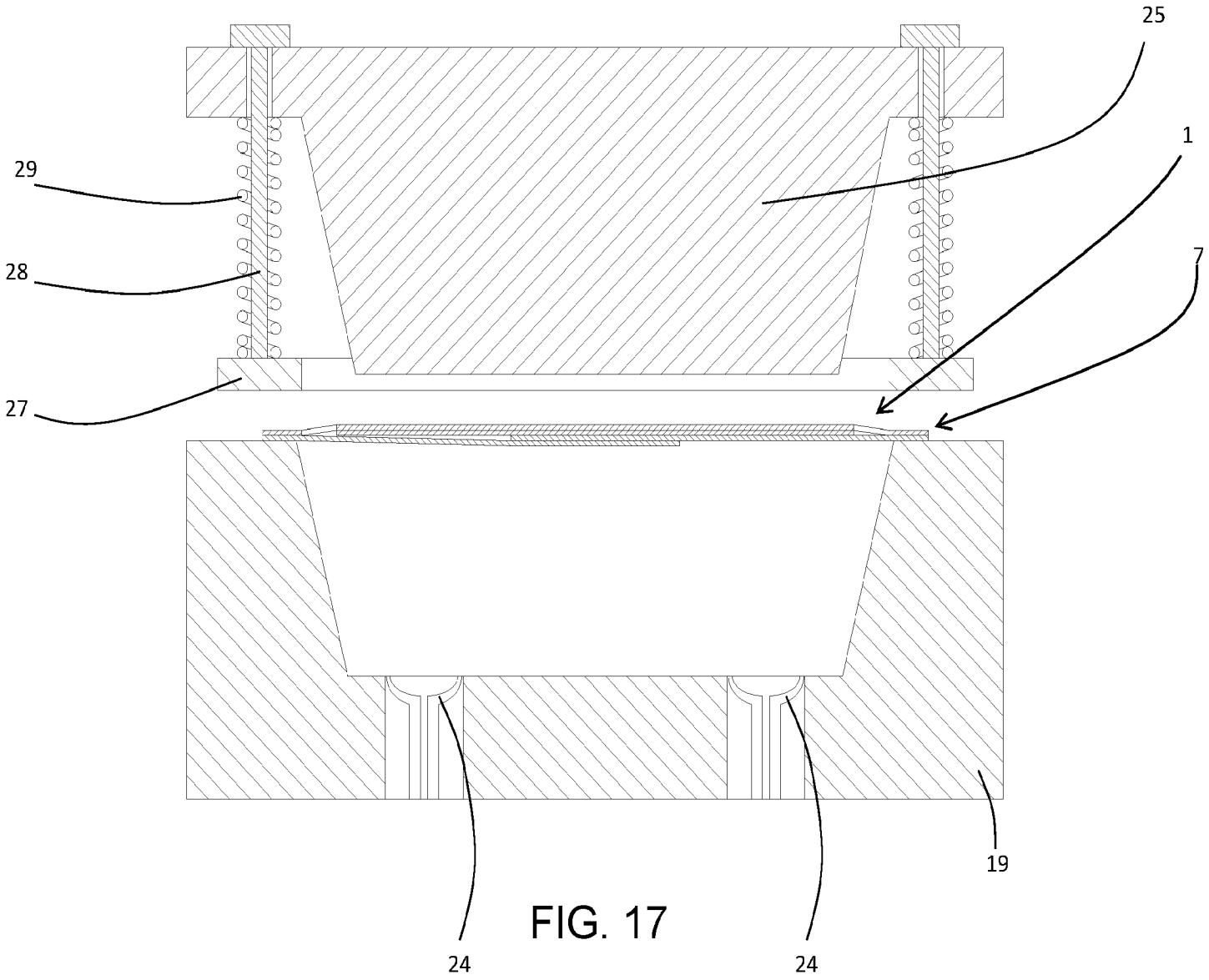
FIG. 17 shows a variant of an apparatus usable in the context of this invention, in an intermediate step relative to those of FIGS. 1 and 2.

Alternatively, according to what is illustrated in FIG. 17, the paper-industry article 1 can initially be simply positioned above the female mould 19, and can be held in position by a presser element 27 which is movable relative to the female mould 19, between a position in which it is away from it (FIG. 17) and a position in which it clamps the continuous annular frame 7 between it and the female mould 19.

Figure 2:
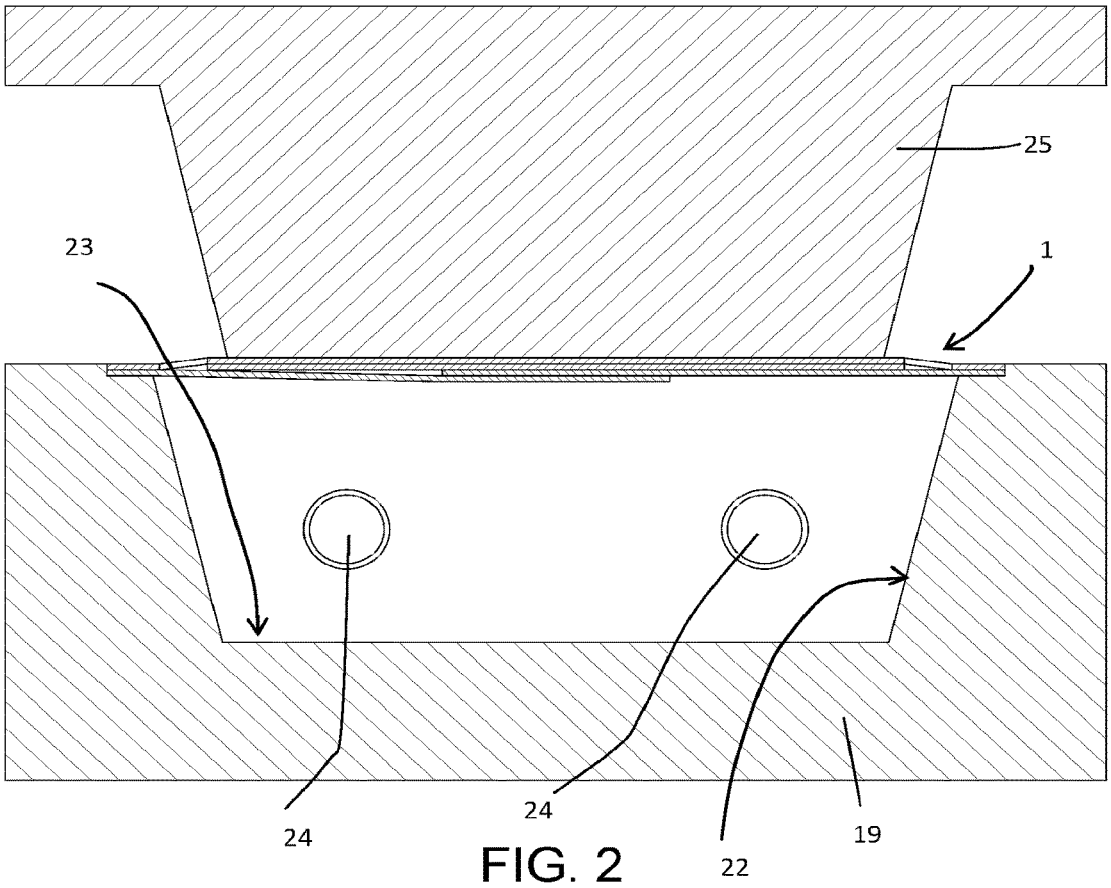
FIG. 2 is a schematic vertical section of a second step of the method according to this invention.

Then comes the step of covering at least partly the lateral surfaces 22 and the bottom surface 23 of the female mould 19 with the wings 10 of the paper-industry article 1. For that purpose, the lateral surfaces 22 and/or bottom surface 23 of the female mould 19 may be equipped with suckers 24 for retaining the respective portions of the wings 10 (FIGS. 1 and 2).

Figure 3:
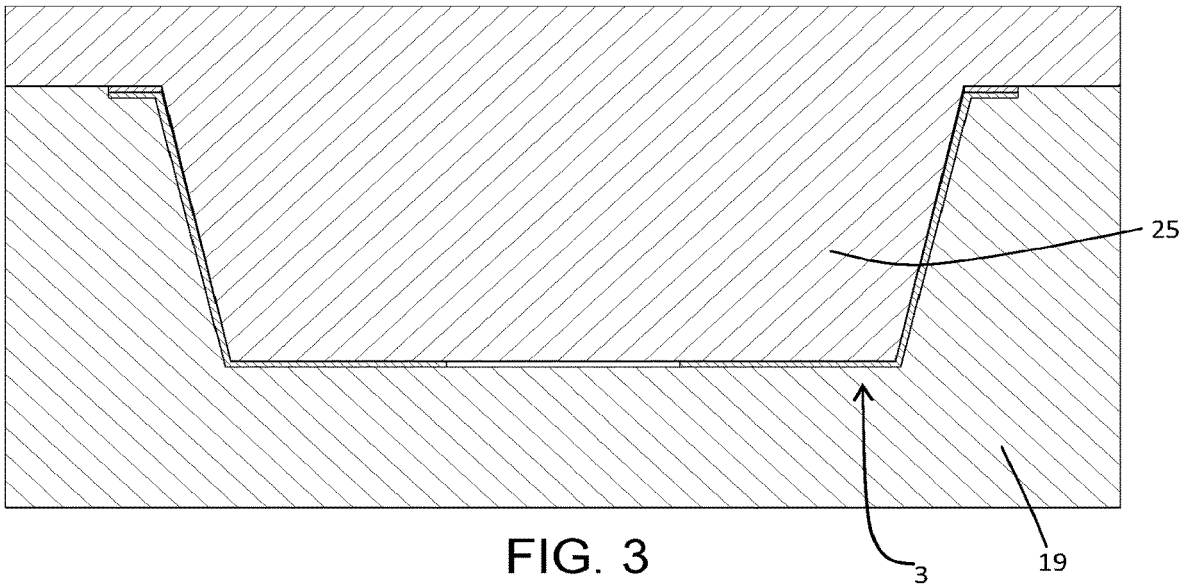
FIG. 3 is a schematic vertical section of a third step of the method according to this invention.
Figure 4:
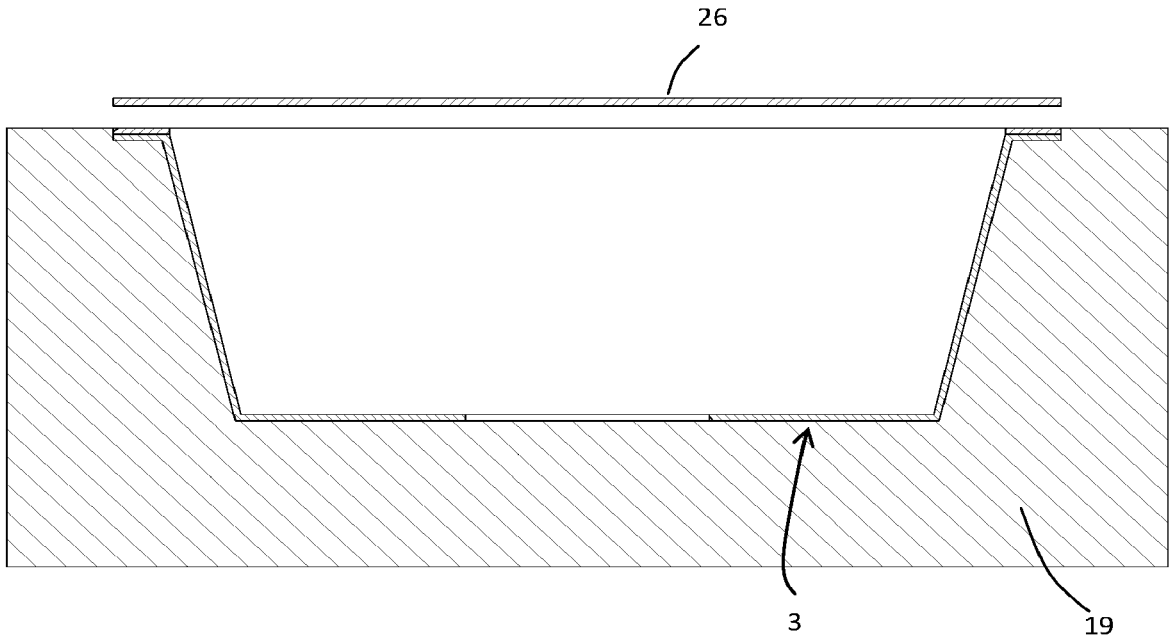
FIG. 4 is a schematic vertical section of a fourth step of the method according to this invention.

Advantageously, the step of at least partly covering the lateral surfaces 22 and the bottom wall 6 of the female mould 19 with the wings 10, comprises the step of pushing the wings 10 against the female mould 19 by inserting into the female mould 19 a male-shaped shaping unit 25, which is also advantageously shaped to match the female mould 19) which changes the shape of the paper-industry article 1, from the flat configuration (FIG. 2) to the three-dimensional configuration (FIG. 3).

In the case of the embodiment in FIG. 17, the presser element 27 is supported by the shaping unit 25 and is movable with it relative to the female mould 19. However, at the same time, the presser element 27 is also movable relative to the shaping unit 25 to which it is connected by means of sliding pins 28 associated with springs 29 suitable for keeping the presser element 27 closer to the female mould 19 than the shaping unit 25 when everything is in the home condition of FIG. 17. In fact, in this way, with a single downward movement it is possible first to lock the paper-industry article 1 in place and immediately afterwards to change its shape from the flat configuration to the three-dimensional configuration At that point it is possible to carry out the step of thermoforming the inner layer 9 of thermoplastic material, using the thermoforming device 20 into which the paper-industry article 1 has been inserted (step not illustrated in detail, since in itself it is similar to any prior art thermoforming step). Consequently, a film 26 of thermoplastic material will be positioned over the female mould 19, and clamped in a gas-tight way between the female mould 19 and a counter-mould (not illustrated) equipped with suitable heating means. The thermoforming step may be carried out either by only creating a vacuum in the female mould 19, or by also creating an overpressure between the film 26 and the counter-mould.

This invention brings important advantages.

First, thanks to this invention it is possible to make containers equipped with an outer skeleton, for which it is possible to weld a sealing film to the perimetric flange without encountering the problems which exist in prior art solutions, and this invention makes it possible to do so in an extremely fast and easy way.

Furthermore, the embodiment in which the paper-industry article has an extension in terms of length and width which remains identical in the flat configuration and in the three-dimensional configuration, offers the considerable advantage of allowing minimisation of the dimensions of the thermoforming equipment compared with the prior art ones in which, in contrast, the starting paper-industry article always has an extension (length and width) significantly greater than the outer skeleton to be formed. Consequently, it is possible both to minimise the dimensions of the plants, the containers made being equal, and to simultaneously make a greater number of containers than using traditional plants. Furthermore, that makes it possible to reduce the waste thermoplastic material compared with prior art plants in which, before thermoforming, the thermoplastic material covers the entire area affected by the flat paper-industry product.

Finally, it should be noticed that this invention is relatively easy to produce and that even the cost linked to implementing the invention is not very high. The invention described above may be modified and adapted in several ways without thereby departing from the scope of the inventive concept. All details may be substituted with other technically equivalent elements and the materials used, as well as the shapes and dimensions of the various components, may vary according to requirements.

The invention claimed is:

1. A paper-industry article for making an outer skeleton (3) to be coupled to an inner layer (9) of thermoplastic material for making a container (2), wherein the paper-industry article (1) is obtained from the transformation of paper or cardboard into a product, wherein the container (2) comprises a bottom wall (6), a plurality of lateral walls (5) which are connected at the bottom to the bottom wall (6), and an annular perimetric flange (4) which extends outward from an upper edge of the lateral walls (5), in the container (2) the outer skeleton (3) being configured to be arranged at the perimetric flange (4), at the lateral walls (5) and at the bottom wall (6), the paper-industry article (1) comprising:

a continuous annular frame (7) configured to constitute the outer skeleton (3) of the container (2) at the perimetric flange (4) of the container (2); and a plurality of wings (10) which extend starting from the continuous annular frame (7), each of the wings (10) being configured to constitute the outer skeleton (3) at one of the lateral walls (5) of the container (2), and at least one of the wings (10) also being configured to constitute the outer skeleton (3) also at the bottom wall (6) of the container (2).

2. The paper-industry article according to claim 1 wherein the paper-industry article (1) extends mainly parallel to a main plane of extension of the continuous annular frame (7).

3. The paper-industry article according to claim 2 wherein the continuous annular frame (7) is at least partly superposed on one or more of said wings (10) and/or wherein at least some of said wings (10) are partly superposed on each other.

4. The paper-industry article according to claim 2 wherein the paper-industry article (1), observed perpendicularly to the main plane of extension, has an outer profile defined by an outer portion of the continuous annular frame (7).

5. The paper-industry article according to claim 4 wherein said wings (10) extend at least partly from the continuous annular frame (7) inward and wherein each wing (10) is at least partly superposed on at least one of the other wings (10).

6. The paper-industry article according to claim 1 wherein the continuous annular frame (7) has a continuous upper surface (8) suitable for in use being coupled to the inner layer (9) of thermoplastic material of the container (2).

7. The paper-industry article according to claim 1 comprising at least one main sheet (13) which has an annular portion (15) which defines at least one continuous upper surface (8) of the continuous annular frame (7), wherein the annular portion (15) is also at least partly superposed on one or more of said wings (10).

8. The paper-industry article according to claim 4 wherein the continuous annular frame (7) has a continuous upper surface (8) suitable for in use being coupled to the inner layer (9) of thermoplastic material of the container (2).

9. The paper-industry article according to claim 4 comprising at least one main sheet (13) which has an annular portion (15) which defines at least one continuous upper surface (8) of the continuous annular frame (7), wherein the annular portion (15) is also at least partly superposed on one or more of said wings (10).

10. The paper-industry article according to claim 2 wherein said continuous annular frame (7) has an inner edge (16) and an outer edge (17), wherein the continuous annular frame (7) and at least one of said wings (10) are constituted of a single sheet of material, and wherein, alternatively, if observed perpendicularly to the main plane of extension:

said at least one of said wings (10) extends inside the continuous annular frame (7) starting from the inner edge (16) of the continuous annular frame (7); or said at least one of said wings (10) extends starting from the outer edge (17) of the continuous annular frame (7), is folded under the continuous annular frame (7) around the outer edge (17) and the rest of it extends inside the continuous annular frame (7).

11. The paper-industry article according to claim 1 comprising a number of wings (10) equal to a number of lateral walls (5) of the container (2), and/or wherein each wing (10) comprises a main portion (11) shaped in such a way as to completely define the outer skeleton (3) at one of the lateral walls (5), and/or wherein each wing (10) has an additional portion (12) shaped in such a way as to partly define the outer skeleton (3) at the bottom wall (6).

12. The paper-industry article according to claim 1 wherein the paper-industry article (1) is made cardboard- or paperboard-based, and/or wherein the paper-industry article (1) has fold lines at connection zones between its operating portions intended to constitute the outer skeleton (3) respectively at the perimetric flange (4), at each of the lateral walls (5) and at the bottom wall (6), and/or wherein the paper-industry article (1) has one or more holes and/or one or more slits and/or one or more outlines, which are suitable for in use allowing the passage of air between an upper part of it and a lower part.

13. The paper-industry article according to claim 4 comprising a number of wings (10) equal to a number of lateral walls (5) of the container (2), and/or wherein each wing (10) comprises a main portion (11) shaped in such a way as to completely define the outer skeleton (3) at one of the lateral walls (5), and/or wherein each wing (10) has an additional portion (12) shaped in such a way as to partly define the outer skeleton (3) at the bottom wall (6).

14. The paper-industry article according to claim 4 wherein the paper-industry article (1) is made cardboard- or paperboard-based, and/or wherein the paper-industry article (1) has fold lines at connection zones between its operating portions intended to constitute the outer skeleton (3) respectively at the perimetric flange (4), at each of the lateral walls (5) and at the bottom wall (6), and/or wherein the paper-industry article (1) has one or more holes and/or one or more slits and/or one or more outlines, which are suitable for in use allowing the passage of air between an upper part of it and a lower part.

15. Use of a paper-industry article according to claim 1 for making a container (2) comprising an outer skeleton (3) and an inner layer (9) of thermoplastic material coupled to the outer skeleton (3), comprising the operating steps of:

(a) taking the paper-industry article (1);

(b) making the outer skeleton (3) using the paper-industry article (1);

(c) thermoforming the inner layer (9) of thermoplastic material directly on the outer skeleton (3), thereby fixing it to the outer skeleton.

16. The use according to claim 15 wherein the step of making the outer skeleton (3) comprises the step of inserting the paper-industry article (1) into a female mould (19) of a thermoforming device (20), and the step of covering at least partly the lateral surfaces (22) and the bottom surface of the female mould (19) with the wings (10), and wherein the step of thermoforming the layer of thermoplastic material is carried out using the thermoforming device (20) into which the paper-industry article (1) has been inserted.

17. The use according to claim 16 wherein the step of covering with the wings (10) at least partly the lateral surfaces (22) and the bottom surface of the female mould (19), comprises the step of pushing the wings (10) against the female mould (19) by inserting a male-shaped shaping unit (25) into the female mould (19).

* * * * *